US005873678A

United States Patent [19]

Moses

[11] Patent Number: 5,873,678

[45] Date of Patent: Feb. 23, 1999

[54] TENSION ADJUSTMENT MECHANISM EMPLOYING STEPPED OR SERRATED RAMPS FOR ADJUSTING TENSION OF A TENDON FROM A FLOATING MARINE PLATFORM

[75] Inventor: Charles J. Moses, Alvarado, Tex.

[73] Assignee: Continental Emsco Company, Houston, Tex.

[21] Appl. No.: 780,059

[22] Filed: Dec. 23, 1996

[51] Int. Cl.[6] ..... E02D 5/34; E02D 5/76

[52] U.S. Cl. ..... 405/223.1; 405/195.1; 405/224; 166/359; 411/535

[58] Field of Search ..... 405/223, 223.1, 405/224, 224.1, 224.2, 224.3, 224.4; 166/350, 359, 367; 403/97, 342, 343; 384/626; 411/535, 536, 546

[56] References Cited

U.S. PATENT DOCUMENTS

| | | | |
|---|---|---|---|
| Re. 32,384 | 3/1987 | Burchett et al. | 114/294 |
| 1,386,317 | 8/1921 | Claassen | 411/535 X |
| 1,940,278 | 12/1933 | Walker | 411/535 X |
| 2,405,889 | 8/1946 | Kennedy | 411/535 X |
| 3,602,000 | 8/1971 | Meheen | 61/46 |
| 4,320,993 | 3/1982 | Hunter | 405/224 |
| 4,324,194 | 4/1982 | Elliston | 114/264 |
| 4,333,725 | 6/1982 | Peterson | 403/271 |
| 4,359,960 | 11/1982 | Burchett et al. | 114/294 |
| 4,364,323 | 12/1982 | Stevenson | 114/265 |
| 4,374,630 | 2/1983 | Fraser, Jr. | 405/224 |
| 4,379,657 | 4/1983 | Widiner et al. | 405/195 |
| 4,391,554 | 7/1983 | Jones | 405/224 |
| 4,400,112 | 8/1983 | Castel et al. | 405/224 |
| 4,432,670 | 2/1984 | Lawson | 405/224 |
| 4,433,879 | 2/1984 | Morris | 383/626 |
| 4,439,055 | 3/1984 | Quigg et al. | 403/330 |
| 4,459,933 | 7/1984 | Burchett | 114/297 |
| 4,516,882 | 5/1985 | Brewer et al. | 405/224 |
| 4,585,369 | 4/1986 | Manesse et al. | 403/322 |
| 4,611,953 | 9/1986 | Owens | 405/224 |
| 4,640,487 | 2/1987 | Salter | 248/571 |
| 4,746,247 | 5/1988 | Arlt, II et al. | 405/224 |
| 4,759,662 | 7/1988 | Peppel | 405/195 |
| 4,784,529 | 11/1988 | Hunter | 405/227 |
| 4,871,282 | 10/1989 | Jennings | 405/224 |
| 4,881,852 | 11/1989 | Gunderson | 405/224 |
| 4,883,387 | 11/1989 | Meyers et al. | 405/195 |
| 4,892,444 | 1/1990 | Moore | 405/195 |
| 4,907,914 | 3/1990 | Gunderson et al. | 405/224 |
| 5,054,963 | 10/1991 | Williamsson | 405/224 |
| 5,133,578 | 7/1992 | Whightsil et al. | 285/166 |
| 5,160,219 | 11/1992 | Arlt | 405/195.1 |
| 5,240,076 | 8/1993 | Cromar et al. | 166/382 |
| 5,255,746 | 10/1993 | Bridges | 166/348 |
| 5,310,007 | 5/1994 | Parikh | 166/355 |
| 5,324,141 | 6/1994 | Hunter et al. | 405/223.1 |
| 5,363,920 | 11/1994 | Alexander et al. | 166/350 |
| 5,366,324 | 11/1994 | Arlt et al. | 405/195.1 |
| 5,431,511 | 7/1995 | Guy | 405/223.1 |
| 5,482,406 | 1/1996 | Arlt, III | 405/195.1 |

OTHER PUBLICATIONS

"Oil States Industries Flex Joints for TLP Mooring Systems, Drilling and Production Risers," Continental Emsco Company, 1994, Arlington, Texas, 6 pages.

Oil States Industries, drawings, "TCA Components", Mooring Porch Subassembly (Undated).

*Primary Examiner*—Tamara L. Graysay
*Assistant Examiner*—Jong-Suk Lee
*Attorney, Agent, or Firm*—Arnold White & Durkee

[57] ABSTRACT

Vertical movement of a floating marine platform is reduced by tendons extending from the platform to anchors on the seabed. A final tension adjustment to equalize the load on all of the tendons is made by a respective tension adjustment mechanism incorporated into the top connector of each tendon. The tension adjustment mechanism includes a split load ring assembly having an upper ring and a lower ring. The upper ring and the lower ring abut each other at respective complementary surfaces. Each surface has a series of serrated ramps. A rotation of one ring with respect to the other causes the upper ring to climb over the lower ring to thereby increase the tension in the tendon. Rotation of the upper ring with respect to the lower ring, for example, is achieved by a motor driven gear ring.

23 Claims, 6 Drawing Sheets

Fig. 1
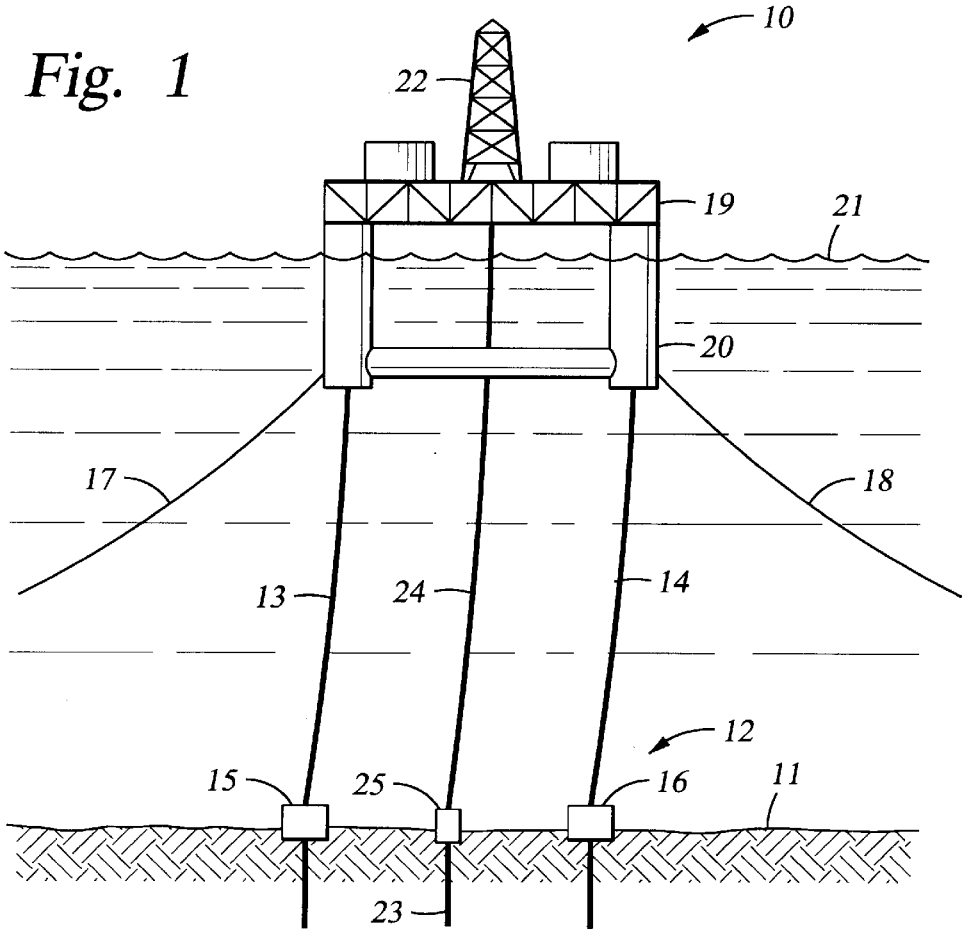
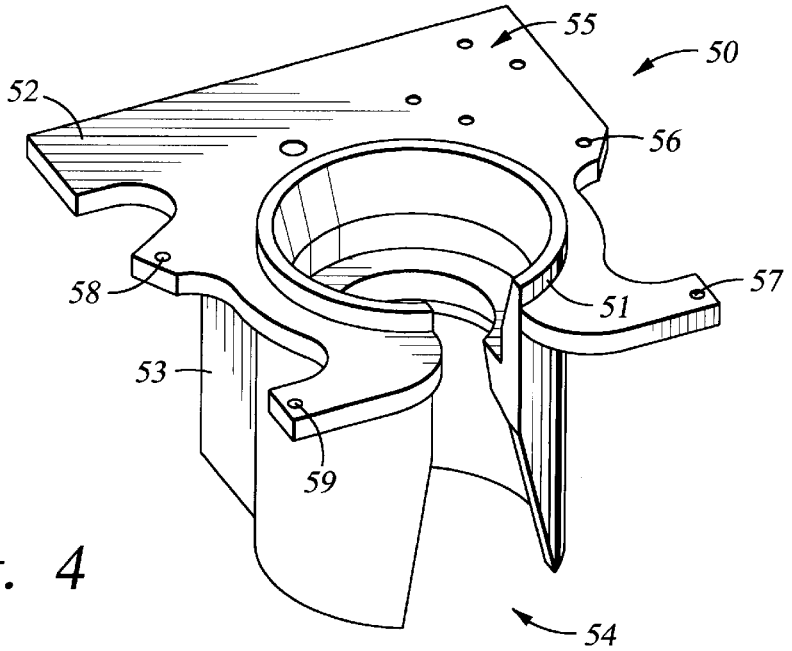
Fig. 4

Fig. 7
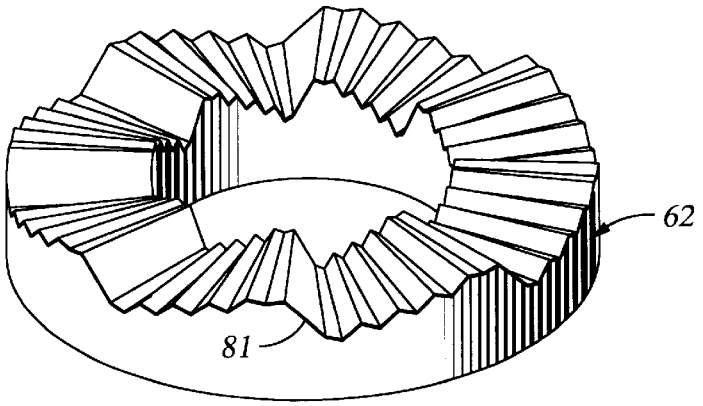
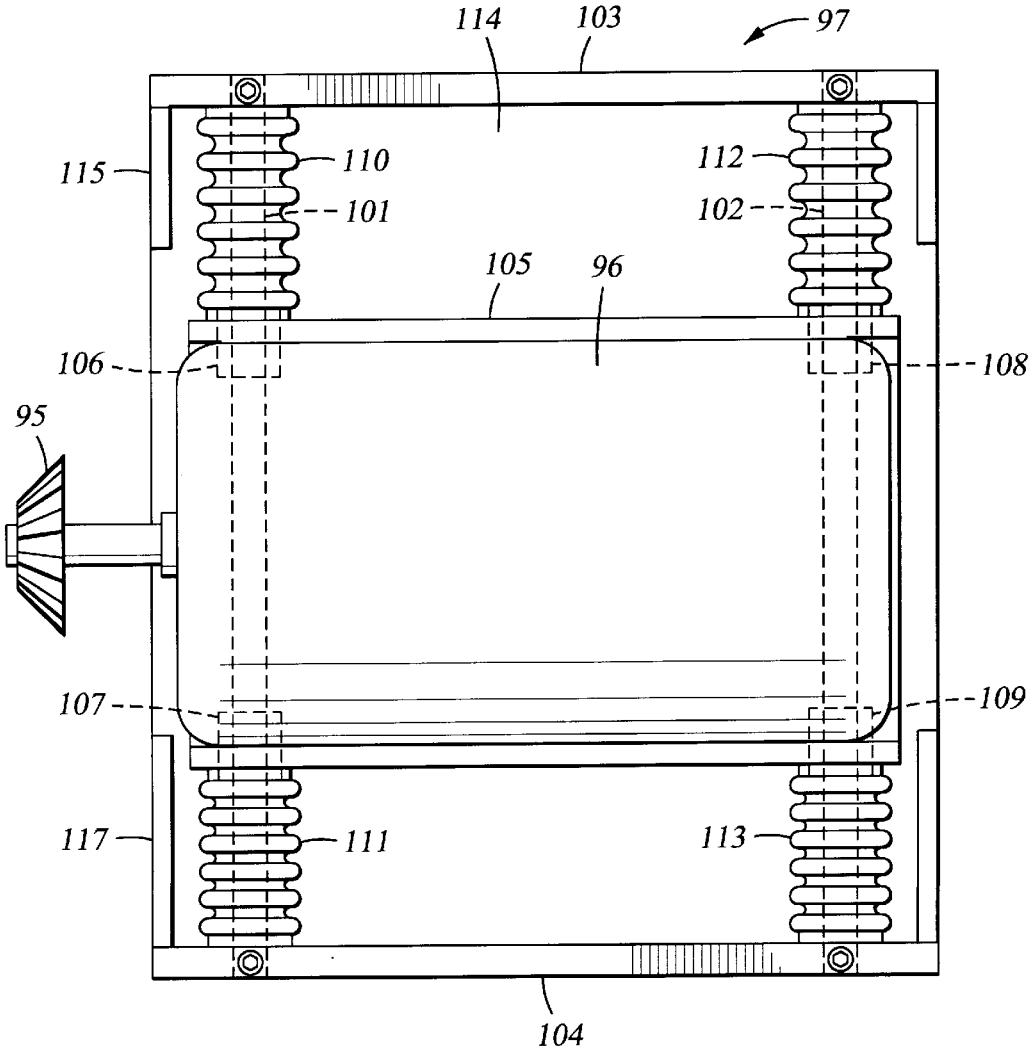
Fig. 8

TENSION ADJUSTMENT MECHANISM EMPLOYING STEPPED OR SERRATED RAMPS FOR ADJUSTING TENSION OF A TENDON FROM A FLOATING MARINE PLATFORM

BACKGROUND OF THE INVENTION

1. Field of the Invention

This invention relates to a tension adjustment mechanism specifically adapted to perform a final tension adjustment to equalize tension in tendon legs of a floating marine platform.

2. Background Art

For offshore drilling operations, it is conventional to moor a floating marine platform by tendons depending from the platform to anchors on the seabed. In such a tendon leg platform (TLP), the tendons hold the platform at a level below its normal buoyancy level in order to reduce vertical buoyant movement of the platform. Therefore, the tendons are put under tensile stress by the buoyancy of the platform.

A final tension adjustment of the tendons of a TLP is usually made after deballasting of the TLP hull. As a result of deballasting, the gross tendon load is applied via vessel buoyancy. A final adjustment to equalize the load in all tendons is made by mechanical means incorporated into a top connector of each tendon. The final adjustment is accomplished by ballasting the TLP to remove load from the tendons, adjusting the lengths of the tendons, and then deballasting again.

The mechanical means used for the final tension adjustment can add a great deal of complexity and weight to the top connector assembly of each tendon. Typically the mechanical means includes a tie-off nut, elastomeric bearing, load ring, adjustment shaft, and corrosion cap. The elastomeric bearing is mounted to the TLP, and the tie-off nut nests upon the elastomeric bearing. The adjustment shaft is threaded and engages the tie-off nut, so that the tie-off nut can be rotated with respect to the adjustment shaft to perform the final tension adjustment.

SUMMARY OF THE INVENTION

By drawing on experience gained over the last fifteen years with TLP installations and mooring systems, designers can predict much more precisely the range of adjustment likely to be required during final equalization of the tendon load. The inventor has recognized that the reduced range of required adjustment provides an opportunity to reduce the weight, complexity, and cost of the mechanism used for the final tendon load adjustment.

In accordance with one aspect, the present invention provides a tension adjustment mechanism for adjustment of a tension member with respect to a mounting member. The tension adjustment mechanism includes an adjusting element abutting the mounting member and coupled to the tension member for applying tension force from the tension member to the mounting member. The mounting member and the adjusting element have opposing stepped inclined surfaces, and at least one of the adjusting element and the mounting member is rotatable for adjustment of the tension force. This construction has the advantage that the steps provide a number of discrete adjustment positions. The mechanism can be adjusted easily to a desired step when the tension is temporarily removed, and held to the desired step once tension is applied.

In accordance with another aspect, the mounting member and the adjusting element of a tension adjusting mechanism abut each other at respective complementary surfaces. The complementary surface of each of the adjusting element and the mounting member have a circular series of ramps of a certain height extending over one circumference such that rotation of one of the adjusting element and the mounting member with respect to another of the adjusting element and the mounting member over a fraction of the one circumference provides a variable displacement between the adjusting element and the mounting member of said certain height for adjustment of the tension force. This construction has the advantage that the adjustment mechanism can be compact and provide a full range of adjustment with a minimal amount of rotation between the adjusting element and the mounting member.

In accordance with yet another aspect, the invention provides a tension adjustment mechanism for adjusting tension of a tendon depending from a floating marine platform. The tension adjustment mechanism includes a split load ring assembly mounted between an upper portion of the tendon and the floating marine platform for applying tension force from the tendon to the floating marine platform. The split load ring assembly includes an upper ring and a lower ring. The upper ring and the lower ring abut each other at respective complementary surfaces. The complementary surface of each of the upper ring and the lower ring has a series of serrated ramps such that rotation of one of the upper and lower rings with respect to another of the upper and lower rings causes the upper ring to climb over the lower ring to thereby increase the tension force. This construction has the advantage that the serrations can be shaped to permit easy adjustment when the tension is temporarily removed, and to lock the adjustment when tension is applied.

In accordance with still another aspect, the invention provides a tension adjustment mechanism for adjusting tension of a tendon depending from a floating marine platform to a subsea anchor. The tension adjustment mechanism includes an adjustable load ring assembly mounted between an upper portion of the tendon and the floating marine platform for applying tension force from the tendon to the floating marine platform. The adjustable load ring assembly includes an upper ring and a lower ring surrounding the upper portion of the tendon. The upper ring and the lower ring have opposed stepped inclined surfaces which extend around the upper portion of the tendon. The upper and lower rings abut each other at steps of the stepped inclined surfaces, and at least one of the upper and lower rings is rotatable for adjustment of the tension force. This construction provides a compact adjustment mechanism that can be installed in a conventional mounting porch. The mechanism can be adjusted easily to a desired step when the tension is temporarily removed, and easily held to the desired step once tension is applied.

In a preferred embodiment, an elastomeric flex element is mounted between the upper portion of the tendon and the upper ring to permit flexing of the tendon with respect to the floating marine platform. The lower ring is fixed to the floating marine platform, and the upper ring is rotatable and includes a gear for engaging a pinion on the shaft of a motor for rotation of the upper ring. The motor is mounted on slides for vertical movement of the motor with respect to the floating platform during adjustment of the tension force.

BRIEF DESCRIPTION OF THE DRAWINGS

Other objects and advantages of the invention will become apparent upon reading the following detailed description with reference to the accompanying drawings wherein:

FIG. 1 is a schematic diagram showing various components associated with a floating marine platform;

FIG. 4 shows a mounting porch subassembly for mounting a top end portion of a tendon to the hull of the floating marine platform shown in FIG. 1;

FIG. 7 is an isometric view of a lower adjusting ring in the tension adjustment mechanism of FIGS. 5 and 6;

FIG. 8 is a plan view of a motor and slide arrangement depicted schematically in FIGS. 5 and 6.

Figure 3:
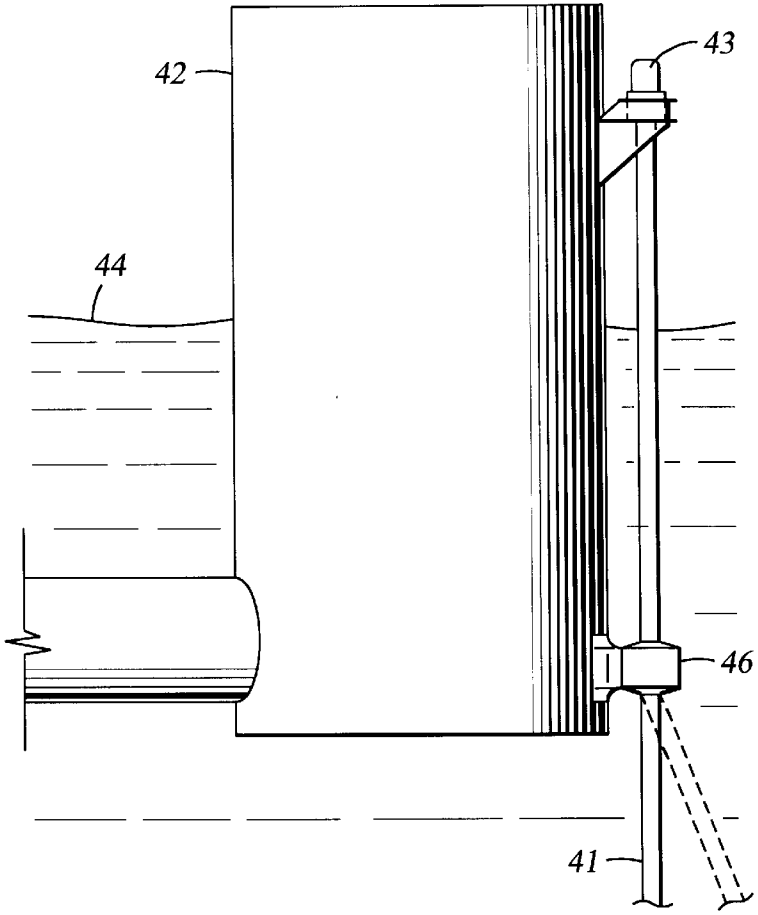
FIG. 3 shows an alternative arrangement for connecting a tendon to an external surface of a hull column of a floating marine platform.

While the invention is susceptible to various modifications and alternative forms, a specific embodiment thereof has been shown in the drawings and will be described in detail. It should be understood, however, that it is not intended to limit the invention to the particular form shown, but on the contrary, the intention is to cover all modifications, equivalents, and alternatives falling within the scope of the invention as defined by the appended claims.

DETAILED DESCRIPTION OF THE PREFERRED EMBODIMENT

Turning now to FIG. 1 of the drawings, there is shown a floating marine platform 10 of the kind used for deep-water offshore drilling. The floating marine platform 10 is anchored to a foundation generally designated 12 on the seabed 11. In order to reduce vertical buoyant movement of the platform 10, generally vertical tendons 13, 14 depend from the platform to anchors 15, 16 in the foundation 12 on the seabed 11. Laterally extending mooring lines 17, 18 depend from the platform 10 to anchors (not shown) on the seabed 11 in order to constrain horizontal movement of the platform 10 as would be caused by currents and wind.

The platform 10 includes a deck 19 on a hull 20. The deck 19 is above the water line 21, and the hull 20 is partially above and partially below the water line.

For drilling, a drill string depends from a derrick 22 on the deck 19 to a well bore 23 in the seabed 11. A portion of the drill string 24 called a "riser" depends from the derrick 22 to a wellhead 25 on the seabed 11.

Although only two tendons 13, 14 are shown in FIG. 1, it should be appreciated that for large platforms more than a dozen tendons may be used. For example, a platform known as "Heidrun" is presently being deployed in 345 meters of water in the North Sea. This platform uses a system of 16 tendons for anchoring to the seabed. Each tendon is designed for a maximum tensile load of about 48 million newtons.

The present invention relates more particularly to a tension adjustment mechanism located at the connection of a top end portion of each tendon 13, 14. It is desirable for the tension adjustment mechanism at the upper end of each tendon to be located above the water line 21. Due to horizontal movement of the platform, however, there should in addition be a relatively flexible mounting of each tendon at a lower most location on the hull 20, in order to prevent the tendon from being snapped by impact with the lowermost portion of the hull. In practice, this has been done by either running the tendon up through the middle of a column of the hull, or mounting the upper portion of the tendon to the outside of a column of the hull.

Figure 2:
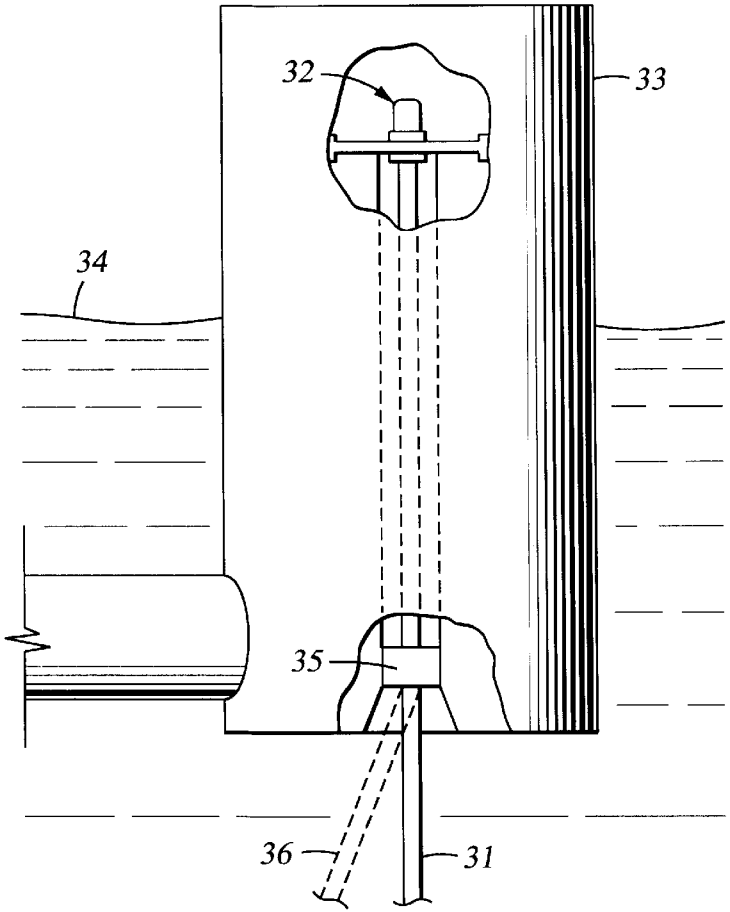
FIG. 2 is a schematic diagram showing a connection of a tendon to a hull column of the floating marine platform shown in FIG. 1.

The case of running the upper portion of a tendon through the middle of a hull column is shown in FIG. 2. The tendon 31 depends from a top end termination 32 mounted to the hull column 33 at a location above the water line 34. Near the bottom of the hull column 33, the tendon 31 passes through a cross load bearing 35 mounted to the column. The cross load bearing 35 permits relatively free axial movement of the tendon 31 but constrains transverse movement. The cross load bearing 35 also permits angular deflection of the portion of the tendon depending from the hull member 33; for example, the tendon may deflect to a position 36 shown in phantom lines.

The cross load bearing 35 includes a flexible elastomeric joint surrounded by a radial elastomeric bearing. Such a flexible elastomeric joint is described, for example, in Whightsil, Sr., et al. U.S. Pat. No. 5,133,578, issued Jul. 28, 1992, and incorporated herein by reference. Suitable cross load bearings are manufactured and sold by Oil States Industries, P.O. Box 670, Arlington, Tex. 76004.

The case of a mounting of the upper portion of a tendon 41 to the side of a hull column 42 is shown in FIG. 3. The top end connection 43 is mounted to the side of the hull column 42 above the water line 44, and a cross load bearing 46 is mounted to the side of the hull column below the water line 44 and near the bottom of the hull column.

Preferably, the top end connection 32 in FIG. 2 or 43 in FIG. 3 includes a mooring porch subassembly fixed to the hull column. Shown in FIG. 4 is a suitable mooring porch subassembly generally designated 50. The mooring porch subassembly 50 transmits the tension in the tendon (not shown) to the hull. The mooring porch is a weldment consisting of a forged, machined load ring 51 and a number of plates 52, 53. The plates 52, 53, performing as webs and flanges, serve to stabilize the load ring 51 as well as bridge loads between the hull (not shown) and the tendon (not shown).

During installation, the rear portion of the mooring ring 50 is welded or otherwise secured to the hull, and the tendon is inserted into load ring 51. As shown in FIG. 4, the mooring porch 50 may include a front slot generally designated 54 for ease of side entry of the tendon during installation.

For practicing the present invention, the mooring ring 50 is similar to a conventional mooring ring except provision is made for mounting of an adjustment motor 96 shown in FIGS. 5 to 6 and 8 to 9 described below. The upper plate 52 of the mooring porch 50 has four holes generally designated 55 for mounting of the motor to the mooring porch subassembly. The upper plate 52 includes a number of additional holes 56 to 59 for termination of electrical cables (not shown) for cathodic protection.

Figure 5:
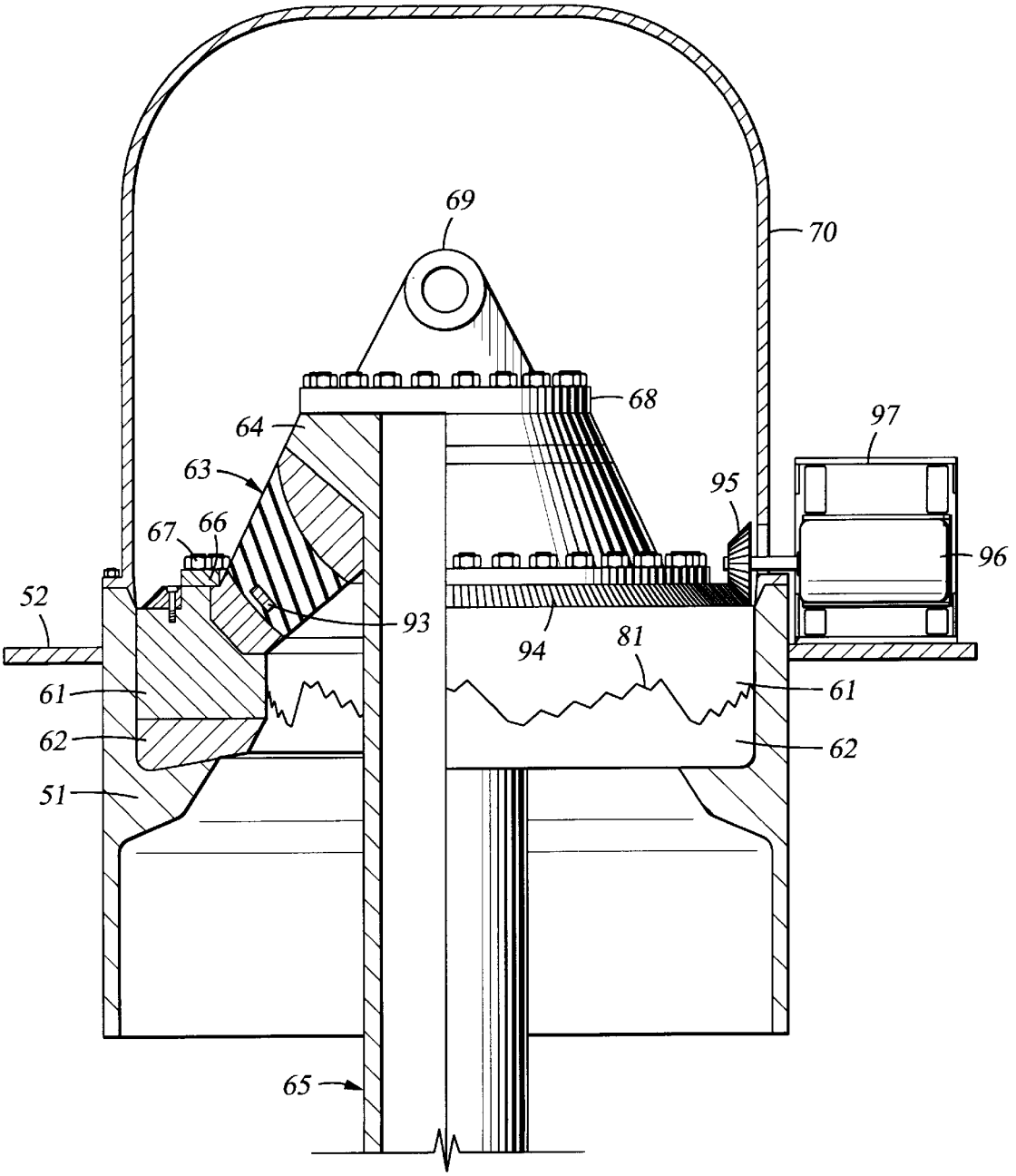
FIG. 5 is a schematic diagram, in partial section, showing a tension adjustment mechanism according to the present invention.
Figure 6:
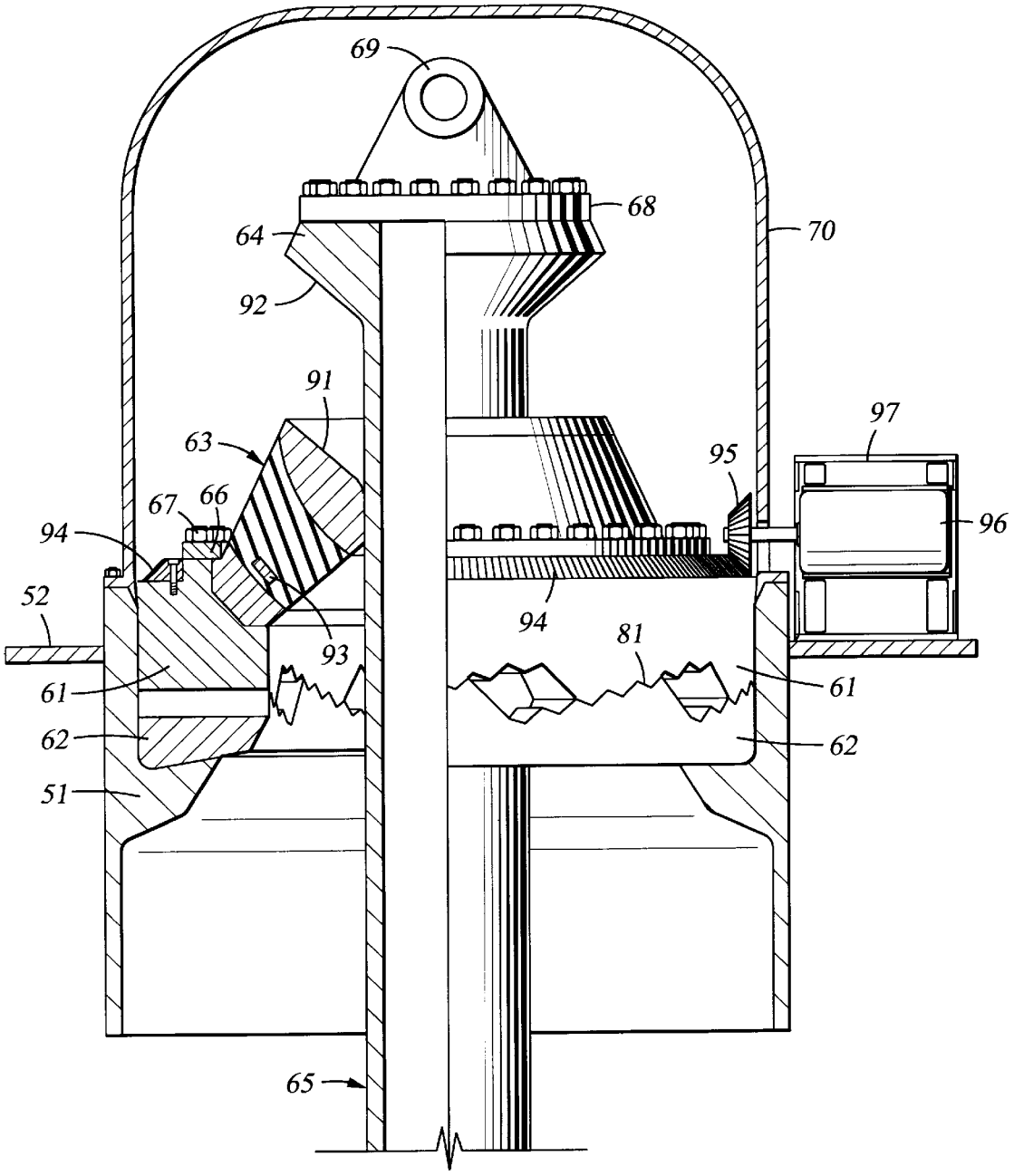
FIG. 6 is a schematic diagram similar to FIG. 5 but showing the tension adjustment mechanism during an intermediate step in an adjustment process.

Turning now to FIG. 5, the tensioning adjustment mechanism according to the present invention is shown in partial section. Seated in the mooring load ring 51 is an adjustable load ring assembly including an upper ring 61 and a lower ring 62. Seated in the upper ring 61 is an elastomeric flex joint bearing 63 supporting a top end 64 of a tendon generally designated 65. A clamping ring 66 is secured by bolts 67 to the upper ring 61 so that the elastomeric flex bearing 63 is secured to the upper ring 61. The upper and lower load rings 61, 62, and the other metallic components in FIG. 6, are preferably made of steel, stainless steel, or titanium, depending on desired corrosion resistance and weight requirements.

The elastomeric flex bearing 63 is a conventional quasi-spherical elastomeric bearing and includes two metal rings separated by elastomer such as rubber, and annular metal laminations are embedded in the elastomer. An elastomeric flex bearing for supporting a maximum axial load of 48 million newtons, for example, has a height of about 56 cm, an inner diameter of about 70 cm, and an outer diameter of about 170 cm. Such an elastomeric flex bearing 63 is manufactured and sold by Oil States Industries, P.O. Box 670, Arlington, Tex. 76004.

The tendon 65 is comprised mainly of a metal pipe terminated at its upper end by a cap 68 having an eye ring 69 for hoisting of the tendon. The end cap seals the metal pipe of the tendon 65 for neutral buoyancy.

The adjustable load ring assembly 61, 62, the elastomeric flex bearing 63, and the upper portion of the tendon 65 are protected from salt spray by a corrosion cap 70 fastened to the upper rim of the mooring porch load ring 51.

The adjustable load ring assembly 61, 62 adjusts tension in the tendon by an angular displacement of the upper load ring 61 with respect to the lower load ring 62. The upper and lower rings 61, 62 abut each other at a series of stepped inclines or serrated circumferential ramps 81. The entire series of ramps is shown in the isometric view of FIG. 7. In this example, eight separate ramps or staircases, each having an identical shape and height, are uniformly distributed about the circumference of the lower load ring 62. Each ramp or staircase has five serrations or steps. The lower surface of the upper ring 61 is complementary to the upper surface of the lower ring 62. Moreover, each of the serrations or steps has a similar shape. Consequently, the upper ring 61 can index with the lower ring 62 so that the serrations or steps can align to provide five distinct values of vertical displacement of the upper ring 61 with respect to the lower ring 62. At any of these indexed positions, the tension in the tendon locks the load rings together preventing relative angular displacement of the rings with respect to each other and, therefore, locking the tension adjustment.

For the sake of illustration, a case of five steps per ramp has been shown. It should be appreciated, however, that a larger number of steps, such as ten or more, can be incorporated into each ramp for a finer granularity of tension adjustment. It should also be appreciated, however, that the range of adjustment is limited by the height of the ramp. Although this range is less than that obtainable with a conventional tension adjustment mechanism, it has been discovered that if reasonable care is exercised in the design and construction of the tendons, only a relatively small range of adjustment is needed. The Heidrun platform described above, for example, required less than a four inch range of adjustment.

An intermediate step in the adjustment procedure is shown in FIG. 6. A comparison of FIG. 5 to FIG. 6 shows that the position of the tendon 65 is relatively unchanged but the mooring porch load ring 51 has been depressed considerably by deballasting of the hull. In particular, the hull has been sufficiently deballasted so that the upper surface 91 of the elastomeric flex bearing 63 is substantially spaced from the lower mating surface 92 of the upper portion of the tendon 65. Due to this spacing, the tendon 65 no longer applies a tension force onto the adjustable load ring assembly 61, 62 so that the upper load ring 61 can be rotated easily with respect to the lower load ring 62 in order to perform a tension adjustment.

The desired amount of adjustment for the tendon is determined by the amount of tension present in the original configuration of FIG. 5. Preferably, a series of force transducers 93 are built into the elastomeric flex bearing 63. Therefore, in the original configuration of FIG. 5, the respective tensile force in each tendon can be measured, and from the collection of measurements and the spring constant of the elastomeric flex joint 63, a vertical displacement value can be computed for equalizing the tension on the tendons. This desired value of vertical displacement is then obtained by a selected amount of angular displacement of the upper and lower load rings 61, 62 with respect to each other. In the example of FIG. 6, for example, it has been determined that the desired vertical displacement corresponds to two serrations or steps in the staircases 81.

In order to effect an angular displacement between the upper load ring 61 and the lower load ring 62, a circumferential bevel gear 94 is attached to the upper circumference of the upper load ring 61. The circumferential bevel gear 94 mates with a bevel gear pinion 95 mounted on the shaft of a motor 96. The circumferential bevel gear 94 need not extend a full circumference about the tendon 65, because a full range of tension adjustment can be obtained over a fraction of a full circumference. For example, for the case of eight staircases or ramps over a full circumference, a full range of tension adjustment can be obtained with a 45 degree range of angular displacement between the upper load ring 61 and the lower load ring 62.

Figure 9:
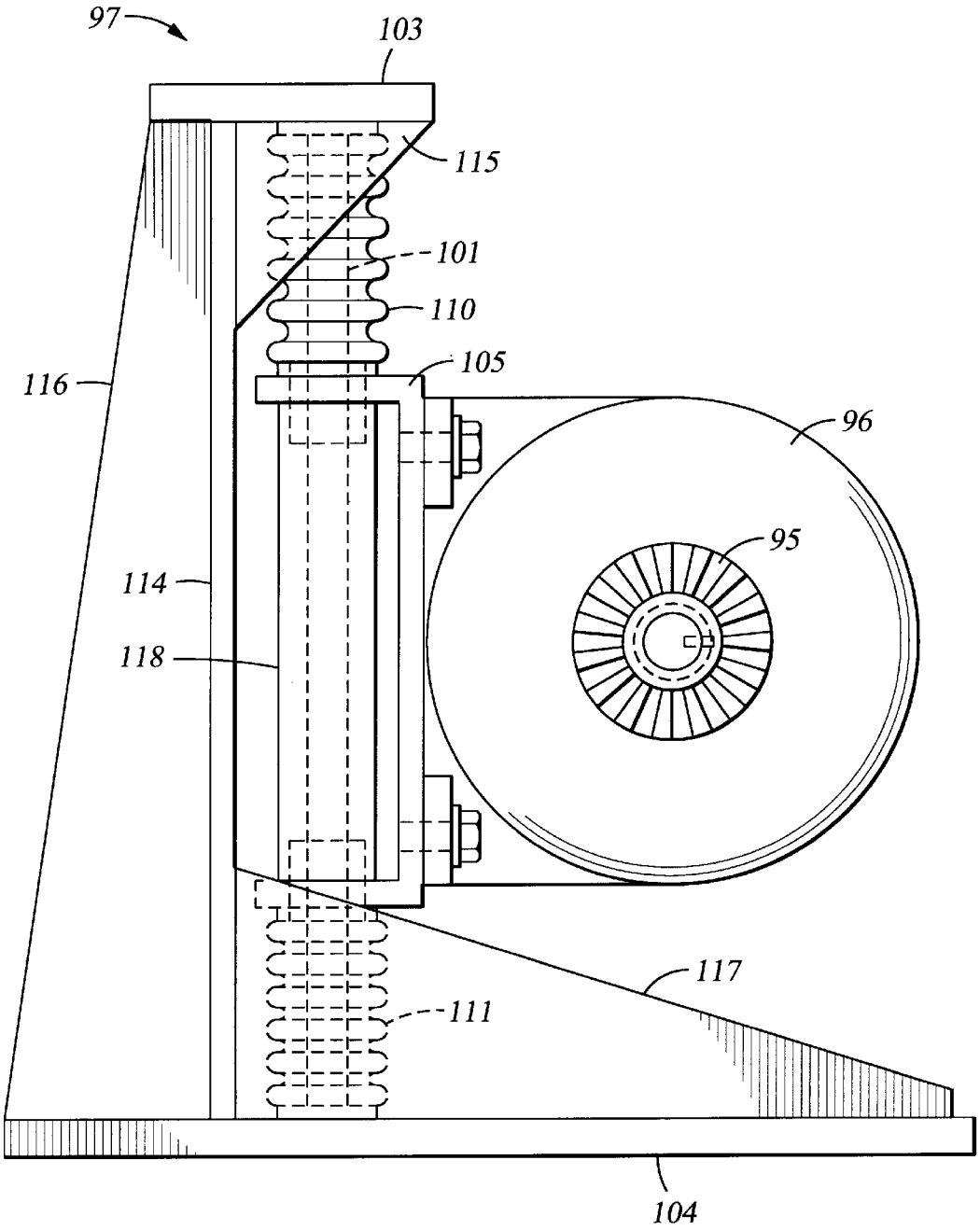
FIG. 9 is an end view of the motor and slide assembly introduced in FIG. 8.

The motor 96 is mounted to the upper plate 52 of the mooring porch via a slide mechanism 97 which is schematically shown in FIGS. 5 and 6 and is shown in further detail in FIGS. 8 and 9. The slides of the slide mechanism 97 permit the motor 96 to move vertically with respect to the mooring porch as the vertical displacement is adjusted between the upper load ring 61 and the lower load ring 62. The motor 96, for example, is a pneumatic or electric motor, and has internal speed reduction gearing to provide a relatively high amount of torque.

Turning now to FIG. 8, there is shown a front view of the motor 96 and slide assembly 97. The slide assembly includes two vertical parallel spaced slide rods 101 and 102 that span a top plate 103 and a bottom plate 104. The motor 96 is fastened to a carriage 105 having four bearings 106, 107, 108, 109 which engage the respective slides 101 and 102. To protect the slide surfaces from salt spray and foreign matter, the slides 101, 102 are enclosed by respective rubber bellows 110, 111, 112, and 113.

As shown in FIG. 9, the top plate 103 and the bottom plate 104 are joined by a back plate 114 and bracing plates 115, 116, and 117. The motor carriage 105 includes a pipe 118 protecting the portion of the guide rod 101 that is spanned by the motor carriage.

In view of the above, there has been described a mechanism employing stepped or serrated ramps 81 on split load rings 61, 62 for a final tension adjustment to equalize tension in tendon legs 14 of a floating marine platform. The split load rings 61, 62 are more compact, lighter, and less costly to manufacture than the tie-off nut, load adjustment ring, and adjustment shaft used in a conventional adjustment mechanism.

It should be apparent that the preferred embodiment shown in the drawings can be modified in various ways to practice the invention as defined by the claims. For example, it should be appreciated that slides (101, 102 in FIG. 8) are used for mounting the motor 96 so that no modifications are needed to a conventional mooring porch load ring 51 and in order to simplify the gearing to the split load rings 61, 62. Alternatively, a stationary motor fixed to the mooring porch, for example, could be used if the pinion on the motor shaft were a worm gear meshing with vertical gearing on the outer peripheral surface of the upper split load ring 61. Another alternative construction could rotate the lower load ring 62 with a fixed motor and use a spline or keyway between the upper load ring 61 and the mooring porch load ring 51 to prevent rotation of the upper load ring 61 with respect to the mooring porch load ring 51.

One should also appreciate that the granularity of the tension adjustment is determined by the vertical size of the steps or serrations in the abutting complementary surfaces of the upper load ring 61 and lower load ring 62. Although this granularity can be reduced to a practical level by increasing the number of steps in each ramp, it would also be possible to stack three or more adjustable load rings, instead of two, in order to further decrease the granularity of the tension adjustment. For example, abutting complementary surfaces between first and second lower adjustable load rings could have at least ten one-millimeter high steps per ramp, and abutting complementary surfaces between the second adjustable load ring and a third and upper adjustable load ring could have at least ten one-centimeter high steps per ramp. In this example, the vertical distance between the first and third adjustable load rings could be adjusted to any value from 0 mm to 99 mm, in one mm increments, by rotating the second adjustable load ring with respect to the first adjustable load ring to select a millimeter digit value of the vertical distance, and rotating the third adjustable load ring with respect to the second adjustable load ring to select a centimeter digit value of the vertical distance.

What is claimed is:

1. A tension adjustment mechanism for adjusting tension of a tendon depending from a floating marine platform, the tension adjustment mechanism comprising a split load ring assembly mounted between an upper portion of the tendon and the floating marine platform for applying tension force from the tendon to the floating marine platform, the split load ring assembly including an upper ring and a lower ring, the upper ring and the lower ring abutting each other at respective complementary surfaces, the complementary surface of each of the upper ring and the lower ring having a series of serrated ramps such that rotation of one of the upper and lower rings with respect to the other of the upper and lower rings causes the upper ring to climb over the lower ring to thereby increase the tension force.

2. The tension adjustment mechanism as claimed in claim 1, wherein serrations in the complementary surfaces are shaped to resist angular displacement of the upper ring with respect to the lower ring when the tension force is applied from the tendon to the floating marine platform.

3. The tension adjustment mechanism as claimed in claim 1, wherein the upper and lower rings each encircle the tendon.

4. The tension adjustment mechanism as claimed in claim 1, wherein the serrated ramps are uniformly distributed circumferentially over each of the complementary surfaces.

5. The tension adjustment mechanism as claimed in claim 1, wherein the lower ring is fixed with respect to the floating platform.

6. The tension adjustment mechanism as claimed in claim 1, further including a motor coupled to said one of the upper ring and the lower ring for rotation of said one of the upper ring and the lower ring.

7. The tension adjustment mechanism as claimed in claim 1, wherein the lower ring is fixed to the floating marine platform, and the upper ring is rotatable and includes a gear for engaging a pinion for rotating the upper ring.

8. The tension adjustment mechanism as claimed in claim 7, further including a motor having a shaft carrying the pinion in engagement with the gear, and slides mounting the motor to the floating platform for vertical movement of the motor with respect to the floating platform during adjustment of the tension force.

9. A tension adjustment mechanism for adjusting tension of a tendon depending from a floating marine platform to a subsea anchor, the tension adjustment mechanism comprising an adjustable load ring assembly mounted between an upper portion of the tendon and the floating marine platform for applying tension force from the tendon to the floating marine platform, the adjustable load ring assembly including an upper ring and a lower ring surrounding the upper portion of the tendon, the upper ring and the lower ring having opposed stepped inclined surfaces which extend around the upper portion of the tendon, the upper and lower rings abutting each other at steps of the stepped inclined surfaces, at least one of the upper and lower rings being rotatable for adjustment of the tension force.

10. The tension adjustment mechanism as claimed in claim 9, further including a motor coupled to said at least one of the upper and lower rings for rotating said at least one of the upper and lower rings.

11. The tension adjustment mechanism as claimed in claim 9, wherein the lower ring is fixed to the floating marine platform, and the upper ring is rotatable and includes a gear for engaging a pinion for rotation of the upper ring.

12. The tension adjustment mechanism as claimed in claim 11, further including a motor having a shaft carrying the pinion in engagement with the gear, and slides mounting the motor to the floating platform for vertical movement of the motor with respect to the floating platform during adjustment of the tension force.

13. A tension adjustment mechanism for adjusting tension of a tendon depending from a floating marine platform to a subsea anchor, the tension adjustment mechanism comprising an adjustable load ring assembly mounted between an upper portion of the tendon and the floating marine platform for applying tension force from the tendon to the floating marine platform, the adjustable load ring assembly including an upper ring and a lower ring surrounding the upper portion of the tendon, the upper ring and the lower ring having opposed stepped inclined surfaces which extend around the upper portion of the tendon, the upper and lower rings abutting each other at steps of the stepped inclined surfaces, at least one of the upper and lower rings being rotatable for adjustment of the tension force, and further comprising an elastomeric flex element mounted between the upper portion of the tendon and the upper ring to permit flexing of the tendon with respect to the floating marine platform.

14. The tension adjustment mechanism as claimed in claim 13, further including a motor coupled to said at least one of the upper and lower rings for rotating said at least one of the upper and lower rings.

15. The tension adjustment mechanism as claimed in claim 13, wherein the lower ring is fixed to the floating marine platform, and the upper ring is rotatable and includes a gear for engaging a pinion for rotation of the upper ring.

16. The tension adjustment mechanism as claimed in claim 15, further including a motor having a shaft carrying the pinion in engagement with the gear, and slides mounting the motor to the floating platform for vertical movement of the motor with respect to the floating platform during adjustment of the tension force.

17. A tension adjustment mechanism for adjusting tension of a tendon depending from a floating marine platform to a subsea anchor, the tension adjustment mechanism comprising an adjustable load ring assembly and an elastomeric flex element coupled to the adjustable load ring assembly for mounting between an upper portion of the tendon and the floating marine platform for applying tension force from the tendon to the floating marine platform, the adjustable load ring assembly including an upper ring and a lower ring for surrounding the upper portion of the tendon, the upper ring and the lower ring having opposed stepped inclined surfaces, the upper and lower rings abutting each other at steps of the stepped inclined surfaces, at least one of the upper and lower rings being rotatable for adjustment of the tension force.

18. The tension adjustment mechanism as claimed in claim 17, wherein each of the opposed stepped inclined surfaces is serrated and extends circumferentially and includes multiple staircases distributed over one circumference.

19. A tension adjustment mechanism for adjusting tension of a tendon depending from a floating marine platform to a subsea anchor, the tension adjustment mechanism comprising an adjustable load ring assembly adapted to be mounted between an upper portion of the tendon and the floating marine platform for applying tension force from the tendon to the floating marine platform, the adjustable load ring assembly including an upper ring and a lower ring for surrounding the upper portion of the tendon, the upper ring and the lower ring having opposed stepped inclined surfaces, the upper and lower rings abutting each other at steps of the stepped inclined surfaces, at least one of the upper and lower rings being rotatable for adjustment of the tension force.

20. The tension adjustment mechanism as claimed in claim 19, wherein the opposed stepped inclined surfaces are serrated to resist rotation of the upper ring with respect to the lower ring when the adjustable load ring assembly applies tension force from the tension member to the floating marine platform.

21. The tension adjustment mechanism as claimed in claim 19, further including a motor coupled to said at least one of the upper ring and the lower ring for rotation of said at least one of the upper ring and the lower ring.

22. The tension adjustment mechanism as claimed in claim 19, wherein each of the opposed stepped inclined surfaces extends circumferentially and includes multiple staircases distributed over one circumference.

23. A tension adjustment mechanism for adjusting tension of a tendon depending from a floating marine platform to a subsea anchor, the tension adjustment mechanism comprising an adjustable load ring assembly adapted to be mounted between an upper portion of the tendon and the floating marine platform for applying tension force from the tendon to the floating marine platform, the adjustable load ring assembly including an upper ring and a lower ring for surrounding the upper portion of the tendon, the upper ring and the lower ring abutting each other at respective complementary surfaces, the complementary surface of each of the upper ring and the lower ring having a circular series of ramps of a certain height extending over one circumference such that rotation of one of the upper ring and lower ring with respect to the other of the upper ring and the lower ring over a fraction of the one circumference provides a variable displacement between the upper ring and the lower ring of said certain height for adjustment of the tension force.

* * * * *